US012089765B2

(12) United States Patent
DiTrolio

(10) Patent No.: US 12,089,765 B2
(45) Date of Patent: Sep. 17, 2024

(54) CONNECTOR ACCESSORY FOR PIPES

(71) Applicant: Philip DiTrolio, Suwanee, GA (US)

(72) Inventor: Philip DiTrolio, Suwanee, GA (US)

( * ) Notice: Subject to any disclaimer, the term of this patent is extended or adjusted under 35 U.S.C. 154(b) by 994 days.

(21) Appl. No.: 17/031,274

(22) Filed: Sep. 24, 2020

(65) Prior Publication Data

US 2021/0000279 A1 Jan. 7, 2021

Related U.S. Application Data

(63) Continuation-in-part of application No. 29/739,477, filed on Jun. 25, 2020, and a continuation-in-part of (Continued)

(51) Int. Cl.
*A47H 1/142* (2006.01)
*E04H 1/12* (2006.01)

(52) U.S. Cl.
CPC ..... *A47H 1/142* (2013.01); *E04H 1/1272* (2013.01)

(58) Field of Classification Search
CPC . A47H 1/02; A47H 1/102; A47H 1/14; A47H 1/142; A47H 1/144; A47H 2001/021; A47H 1/122; E04B 2001/2406; E04B 2001/2409; E04B 2001/2421; E04B 2/2403; E04B 2002/0236; Y10T 403/34; Y10T 403/342; E04H 1/1272; F16B 2200/30
See application file for complete search history.

(56) References Cited

U.S. PATENT DOCUMENTS 409,893 A 8/1889 Wray
1,064,734 A 6/1913 Howe
(Continued)

FOREIGN PATENT DOCUMENTS

CH 483819 1/1970
CN 212295405 U * 1/2021
(Continued)

OTHER PUBLICATIONS

"Non-Final Office Action cited in U.S. Appl. No. 17/188,118, filed Mar. 1, 2021", mailed Apr. 11, 2023, 25 pages.
(Continued)

*Primary Examiner* — Matthew R McMahon
(74) *Attorney, Agent, or Firm* — Johnson, Marcou, Isaacs & Nix, LLC

(57) ABSTRACT

The present coupler-mounted connector enables industry standard hooks on horizontal rods to rest at such a height as to provide uniform appearance to the top of drape walls. The coupler-mounted connector includes an adaptor to support couplers for the drape rods to be mounted on a vertically disposed, affixed coupler, such as a coupler on a pipe, a flat-mounted coupler, or any other coupler. The body of the coupler-mounted connector is positioned around the affixed coupler. The coupler-mounted connector includes a spanning element with a lower wedge to mate with the openings in the upper body of the affixed coupler. The coupler-mounted connector is secured in the coupler with the accessories protruding to one or more sides of the coupler-mounted connector. The accessories are connected to the coupler-mounted connector by one or more connection bridges.

14 Claims, 18 Drawing Sheets

Related U.S. Application Data application No. 15/727,695, filed on Oct. 9, 2017, now Pat. No. 10,941,560.

(60) Provisional application No. 62/907,075, filed on Sep. 27, 2019, provisional application No. 62/417,121, filed on Nov. 3, 2016.

(56) References Cited

U.S. PATENT DOCUMENTS

| | | | | |
|---|---|---|---|---|
| 1,199,553 | A | 9/1916 | Hogan | |
| 1,278,348 | A * | 9/1918 | Hines | A47H 1/122 248/265 |
| 1,710,468 | A * | 4/1929 | Molnar | D06F 57/12 211/98 |
| 1,893,702 | A | 1/1933 | Glenn | |
| 2,689,103 | A | 9/1954 | Ackerman | |
| 3,014,717 | A | 12/1961 | Borodin | |
| 3,469,810 | A | 9/1969 | Dorris | |
| 3,480,243 | A | 11/1969 | Summerville | |
| 3,498,576 | A | 3/1970 | Alissandratos | |
| 3,823,439 | A | 7/1974 | Selset | |
| 3,902,817 | A | 9/1975 | Meir | |
| 4,019,298 | A | 4/1977 | Johnson, IV | |
| 4,036,371 | A | 7/1977 | Michel | |
| 4,261,138 | A | 4/1981 | St George Syms | |
| 4,283,035 | A | 8/1981 | Ojembarrena | |
| 4,361,314 | A * | 11/1982 | Ohlson | E04F 11/181 403/321 |
| 4,723,384 | A | 2/1988 | Mengeringhausen | |
| 4,867,598 | A | 9/1989 | Winter, IV | |
| 4,951,438 | A | 8/1990 | Thoresen | |
| 5,111,631 | A | 5/1992 | Flood | |
| 5,289,665 | A | 3/1994 | Higgins | |
| 5,291,708 | A | 3/1994 | Johnson | |
| 5,421,556 | A | 6/1995 | Dodge et al. | |
| 5,433,416 | A | 7/1995 | Johnson | |
| 5,657,913 | A | 8/1997 | Cucheran et al. | |
| 5,667,178 | A | 9/1997 | Yang | |
| 5,680,737 | A | 10/1997 | Sheipline | |
| 5,769,292 | A | 6/1998 | Cucheran et al. | |
| 5,802,798 | A | 9/1998 | Martens | |
| 5,911,762 | A | 6/1999 | Ott | |
| 6,216,889 | B1 | 4/2001 | Chang | |
| 6,375,140 | B1 | 4/2002 | Shen | |
| 6,375,164 | B1 | 4/2002 | Siegler et al. | |
| 6,530,338 | B2 * | 3/2003 | Okumura | G09F 17/00 403/294 |
| 6,588,713 | B2 | 7/2003 | Kilkenny | |
| 6,595,496 | B1 | 7/2003 | Langlie et al. | |
| 6,595,498 | B1 * | 7/2003 | Andersen | E06B 9/04 256/26 |
| 6,837,016 | B2 | 1/2005 | Simmons | |
| 6,840,482 | B2 | 1/2005 | Downey | |
| 6,952,905 | B2 | 10/2005 | Nickel | |
| 6,969,211 | B2 | 11/2005 | Altman | |
| 7,198,088 | B2 | 4/2007 | McMenamin | |
| 7,343,831 | B1 | 3/2008 | Tamcsin | |
| 7,861,982 | B1 | 1/2011 | McClure | |
| 8,020,328 | B2 | 9/2011 | Lavi | |
| 8,209,924 | B2 | 7/2012 | Foley | |
| 8,209,925 | B2 | 7/2012 | Foley | |
| 8,231,093 | B2 | 7/2012 | Tran | |
| 8,403,280 | B2 | 3/2013 | Halverson et al. | |
| 8,844,907 | B1 | 9/2014 | Davis et al. | |
| 8,905,249 | B2 | 12/2014 | Whitacre | |
| 8,925,238 | B2 | 1/2015 | Anderson | |
| 9,082,324 | B1 | 7/2015 | Brown et al. | |
| 9,211,027 | B2 | 12/2015 | Ovist | |
| 9,271,593 | B1 | 3/2016 | Chang | |
| 9,381,866 | B2 | 7/2016 | Sautter et al. | |
| 9,890,506 | B2 | 2/2018 | Weiner | |
| 9,909,271 | B2 * | 3/2018 | Wiegel | E01F 15/003 |
| 9,931,993 | B2 | 4/2018 | Ward et al. | |
| 10,035,677 | B2 | 7/2018 | Chen et al. | |
| 10,702,085 | B1 | 7/2020 | Newport | |
| 10,765,247 | B2 | 9/2020 | Moss | |
| 10,935,070 | B2 * | 3/2021 | Klein | F16C 11/0695 |
| 11,066,870 | B1 * | 7/2021 | Flannery | A01K 1/035 |
| 11,215,209 | B2 | 1/2022 | Ramey | |
| 11,296,648 | B1 | 4/2022 | Jasmin | |
| 2002/0063248 | A1 | 5/2002 | Siegler et al. | |
| 2002/0096610 | A1 | 7/2002 | Fernandez | |
| 2002/0162929 | A1 | 11/2002 | Downey | |
| 2002/0178998 | A1 * | 12/2002 | Okumura | G09F 17/00 116/174 |
| 2003/0037662 | A1 | 2/2003 | Hsieh | |
| 2005/0023403 | A1 | 2/2005 | Lu | |
| 2005/0095062 | A1 | 5/2005 | Iverson | |
| 2005/0098272 | A1 | 5/2005 | Rizzo | |
| 2006/0165482 | A1 | 7/2006 | Olberding | |
| 2006/0278777 | A1 | 12/2006 | Atkinson | |
| 2007/0210293 | A1 * | 9/2007 | Cheng | E04H 17/18 256/26 |
| 2012/0234990 | A1 | 9/2012 | Lewis | |
| 2014/0082898 | A1 | 3/2014 | Maunder | |
| 2015/0240515 | A1 | 8/2015 | Davis et al. | |
| 2015/0241174 | A1 | 8/2015 | Silvennoinen | |
| 2017/0349080 | A1 | 12/2017 | Sautter | |
| 2018/0119410 | A1 | 5/2018 | Ditrolio | |
| 2022/0136187 | A1 | 5/2022 | Thenemann et al. | |

FOREIGN PATENT DOCUMENTS

| | | | | |
|---|---|---|---|---|
| DE | 102004059072 | A1 | 6/2006 | |
| DE | 202006001094 | U1 | 6/2006 | |
| DE | 202012004360 | U1 * | 12/2012 | A47H 1/06 |
| EP | 1384903 | A1 | 1/2004 | |
| EP | 1850045 | | 10/2007 | |
| FR | 2546953 | A1 | 12/1984 | |
| GB | 2302852 | A | 2/1997 | |
| WO | WO-2021010592 | | 1/2021 | |

OTHER PUBLICATIONS

"Non-Final Office Action issued in U.S. Appl. No. 16/931,556, filed Jul. 17, 2020", 15 pages.
"Non-Final Office Action issued in U.S. Appl. No. 17/188,230, filed Mar. 1, 2021", mailed Apr. 14, 2023, 81 pages.
"Notice of Allowance issued in U.S. Appl. No. 16/931,556, filed Jul. 17, 2020", 19 Pages.
"Non-Final Office Action issued in U.S. Appl. No. 16/931,556, filed Jul. 17, 2020", mailed Jan. 26, 2022, 33 pages.
U.S. Appl. No. 17/188,118 to DiTrolio filed Mar. 1, 2021.
U.S. Appl. No. 17/188,230 to DiTrolio filed Mar. 1, 2021.
"Final Office Action in U.S. Appl. No. 16/931,556", mailed Jul. 20, 2022, 39 pages.
U.S. Appl. No. 15/727,695 to DiTrolio filed Oct. 9, 2017.
U.S. Appl. No. 16/931,556 to DiTrolio filed Jul. 17, 2020.
U.S. Appl. No. 29/739,477 to DiTrolio filed Jun. 25, 2020.
U.S. Appl. No. 17/099,534 to DiTrolio filed Nov. 16, 2020.
"Final Office Action in U.S. Appl. No. 17/188,230, filed Mar. 1, 2021", mailed Oct. 11, 2023, 30 pages.
"Non-Final Office Action in U.S. Appl. No. 17/099,534, filed Nov. 16, 2020", mailed Oct. 24, 2023, 80 pages.
"Non-Final Office Action issued in U.S. Appl. No. 17/188,230, filed Mar. 1, 2021", 24.
"Notice of Allowance issued in U.S. Appl. No. 29/739,477, filed Jun. 25, 2020".
"Final Office Action in U.S. Appl. No. 15/727,695, filed Oct. 9, 2017", mailed Aug. 21, 2020, 15 pages.
"Office Action in U.S. Appl. No. 15/727,695, filed Oct. 9, 2017", mailed Mar. 4, 2020, 16 pages.

* cited by examiner

CONNECTOR ACCESSORY FOR PIPES

CROSS-REFERENCE TO RELATED APPLICATIONS

This application is a continuation-in-part of and claims priority to U.S. application Ser. No. 15/727,695, filed Oct. 9, 2017, and entitled "Connector for Pipes" which claims priority to U.S. Provisional Patent Application No. 62/417,121, filed Nov. 3, 2016, and entitled "Coupler for Pipes." This application also claims priority to U.S. Provisional Patent Application No. 62/907,075, filed Sep. 27, 2019, and entitled "Connector Accessory for Pipes." This application is also a continuation-in-part of and claims priority to U.S. Design application No. 29/739,477 filed Jun. 25, 2020, and entitled "Connector Accessory for Pipes." The entire contents of the above-identified applications are hereby fully incorporated herein by reference.

FIELD OF INVENTION

The present invention relates to couplers for drape rods of the type typically found in exhibit booths. In even greater particularity, the present invention relates to an adaptor to allow one or more couplers or other accessories to be connected to a universal coupler for coupling transverse drape rods to fixed location supports for creating exhibit booths.

BACKGROUND

In the prior art, exhibit booths and the like are constructed using a tubular framework supporting drapes as walls and or covers. Many of these booths are constructed using a hook-and-slot system, which utilize upright aluminum poles with slots formed near the top regions thereof for receiving hooks secured to and extending from the ends of horizontally-positioned tubular rods. Draping material is placed over the horizontal rods to form booths or partitions as may be required. Pipe and drape walls traditionally have a bumpy appearance due to the height difference of the vertical members in relation to the top of horizontally disposed connecting rods. Additionally, the steel hooks on industry standard horizontal drape rods have a tendency to "tear" the aluminum vertical uprights in a "can opener" effect when the steel hooks are inserted in the existing slots in the uprights.

SUMMARY OF THE INVENTION

The present coupler-mounted connector enables industry standard hooks on horizontal rods to rest at such a height as to provide uniform appearance to the top of drape walls. The coupler-mounted connector includes an adaptor to support couplers for the drape rods to be mounted on a vertically disposed, affixed coupler, such as a coupler on a pipe, a flat-mounted coupler, or any other coupler. The body of the coupler-mounted connector is positioned around the affixed coupler. The coupler-mounted connector includes a spanning element with a lower wedge to mate with the openings in the upper body of the affixed coupler. The coupler-mounted connector is thus secured in the coupler with the accessories protruding to one or more sides of the coupler-mounted connector. The accessories are connected to the coupler-mounted connector by one or more connection bridges.

The coupler accessory that is part of the coupler-mounted connector is similar in configuration to the affixed coupler to which the coupler-mounted connector is mounted. The coupler accessory has an upper region with a similar outside dimension as the body of the coupler. In an internal portion of the coupler, at least one hollow well opens vertically with at least one lateral notch or opening formed in the upper region and designed to accept a terminal hook used on an end of a horizontally placed rod. The coupler prevents the steel hooks on industry standard horizontal drape rods from tearing into the support pipes. The coupler allows for the industry standard hooks to be inserted at a wider angle of insertion and easier connection than conventional industry standard slots.

The coupler-mounted connector allows one or more of the couplers to be mounted to an affixed coupler via a connection bridge that connects to the coupler-mounted connector that mounts to the affixed coupler. In an example, the couplers may be in series extending perpendicular from either side of the adaptor or in any suitable direction. In certain other example aspects described herein, methods to prepare and install the coupler-mounted connector are provided. The coupler-mounted connector allows for a greater number of rods to be connected to the multiple couplers. The coupler-mounted connector allows rods and drapes to be hung in parallel and at the same height. Additionally, even when the coupler-mounted connector is mounted on an affixed coupler, the affixed coupler may still be used with connector rods mounted on unused lateral notches or openings.

These and other aspects, objects, features, and advantages of the example embodiments will become apparent to those having ordinary skill in the art upon consideration of the following detailed description of illustrated example embodiments.

BRIEF DESCRIPTION OF THE DRAWINGS

The drawings are appended hereto and form a portion of this disclosure.

DETAILED DESCRIPTION

Figure 1:
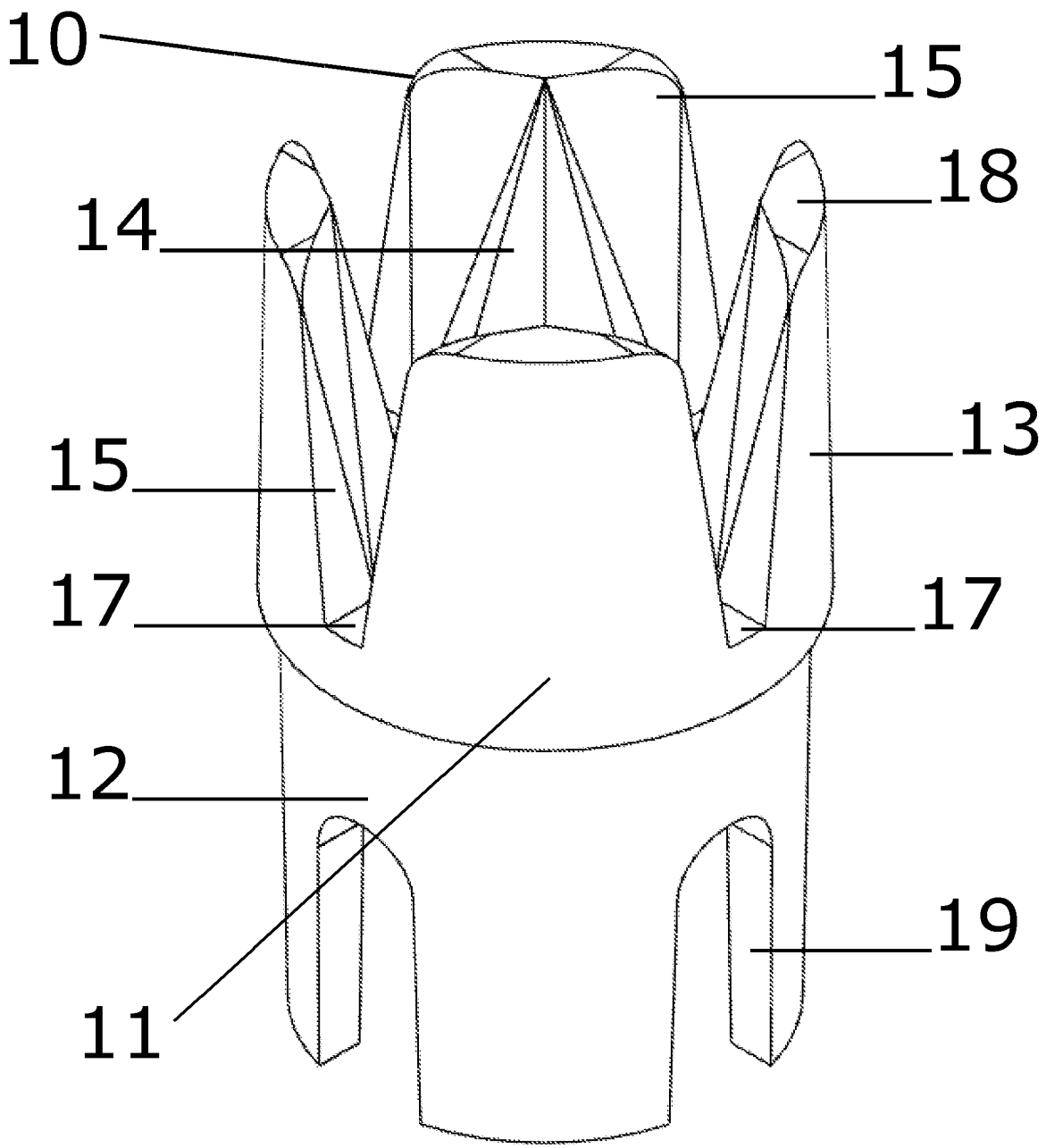
FIG. 1 is a perspective view of an embodiment of an affixed coupler.

The example embodiments described herein provide a coupler-mounted connector 100 with one or more couplers 20 for connecting substantially orthogonally disposed rods to affixed couplers 10 affixed to a vertical rod or other support mechanism in a pipe and drape exhibit booth construction. The "Pipe and Drape" industry, is a subset of exhibition and convention services in which frameworks are constructed from horizontally and vertically disposed members in such a fashion to allow draperies or curtains to hang and create division of space in convention halls or other similar areas by arranging drapery walls and booths. The coupler-mounted connector 100 is designed to provide an improvement to form and function over the industry standard hook and slot technology, yet allow users of existing systems to continue using their inventory of components.

The coupler-mounted connector 100 allows accessories, such as a coupler 20, to be mounted on an affixed coupler 10 that is affixed in any suitable way, such as on a vertical pipe or mounted to a wall. The coupler-mounted connector 100 allows one or more additional couplers 20 or more to be mounted on the affixed coupler 10 in one or more offset positions beside the affixed coupler 10. The couplers 20 may be mounted in series extending from the affixed coupler 10, in parallel on different sides of the affixed coupler 10, or in any other suitable configuration. The coupler-mounted connector 100 allows additional rods to be connected to the top of a single vertical pipe or affixed coupler 10. In examples herein, when one coupler 20 is being described, two or more couplers 20 in any configuration may be envisioned to operate substantially similarly. In the examples, the affixed coupler 10 substantially similar to the couplers 20. In other examples, the affixed coupler 10 is shares similar attributes to the couplers 20, but may have a different configuration.

FIG. 1 is a perspective view of an embodiment of an affixed coupler 10. The one or more couplers 20 displayed as an accessory in FIG. 2 through FIG. 17 may be substantially similar to the affixed coupler 10. However, certain embodiments of the affixed coupler 10 or coupler 20 may have more or fewer openings 15 due to mounting options, such as the connection bridge 43 in FIG. 2. The coupler 10 is used to construct the aforesaid pipe and drape booths. Because the steel terminal hooks traditionally used on the transverse rods in conventional systems to connect to the vertical member or a wall are used to connect to the instant coupler 10, the steel hooks are not illustrated. Coupler 10 has a body 11 and an upper region 13. The body 11 may be substantially circular. In alternate embodiments, the body 11 is another shape, such as square, hexagonal, or oblong. The upper region 13 may be of a similar outside dimension as the body 11 and/or of similar shape as the body 11. In an example, the upper region 13 is affixed to the body 11 or is molded, cast, or otherwise formed as a solitary piece or unit. In an internal portion of the coupler 10, 20, at least one hollow well 14 opens vertically with at least one lateral notch or opening 15 formed in upper region 13 and designed to accept a terminal hook used on an end of a horizontally placed rod. The coupler 10 may include any number of openings, such as 1, 3, 4, or 8. Examples herein illustrate a coupler 10 that has openings 15 disposed at 90 degree positions on the upper region 13. For example, the openings 15 are positioned at 3:00, 6:00, 9:00, and 12:00. In examples, one or more of the openings 15 are replaced by a connection bridge 43 or other connection hardware.

Figure 8:
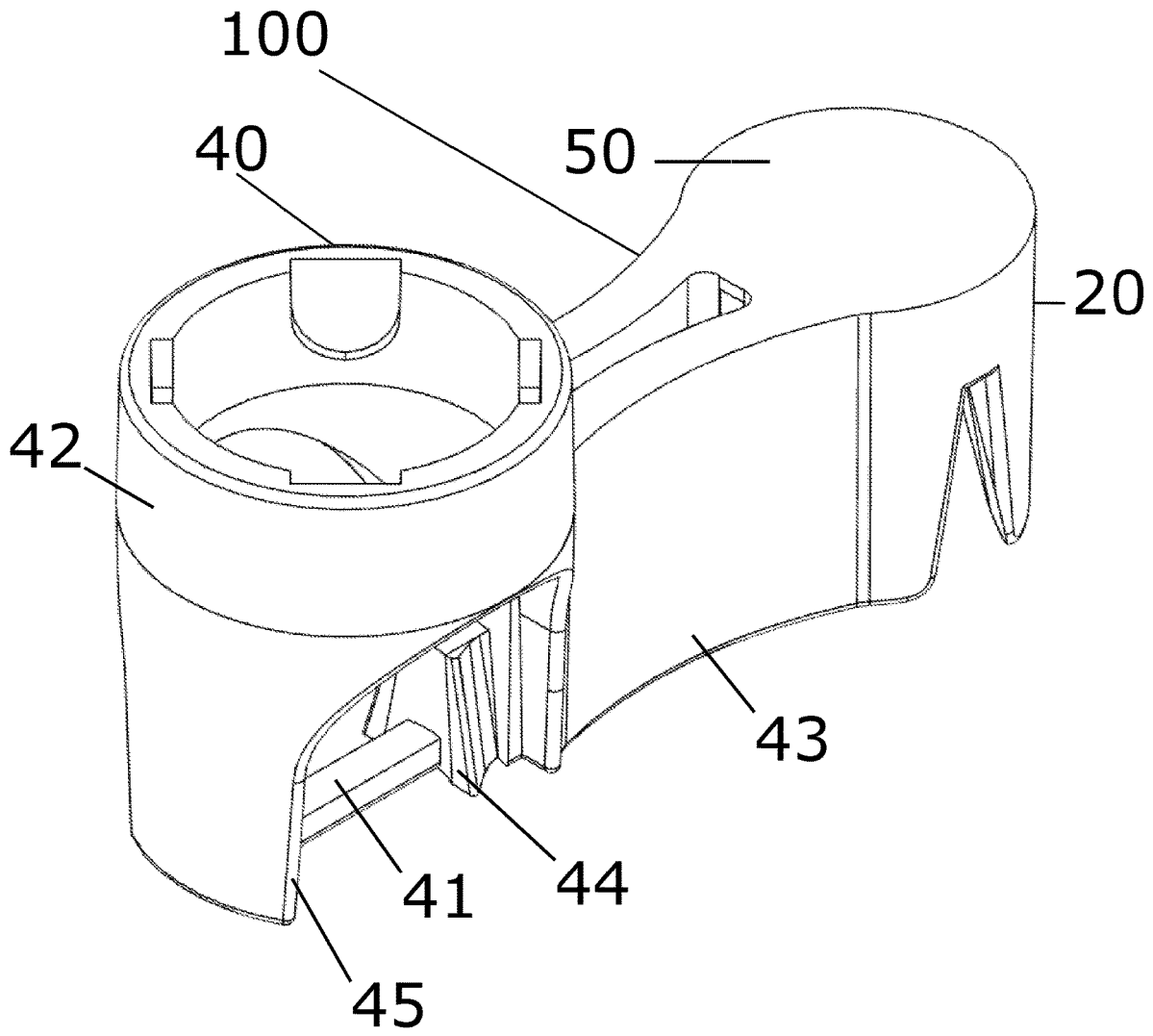
FIG. 8 is a bottom perspective view of one embodiment of the coupler-mounted connector with the coupler adaptor.
Figure 9:
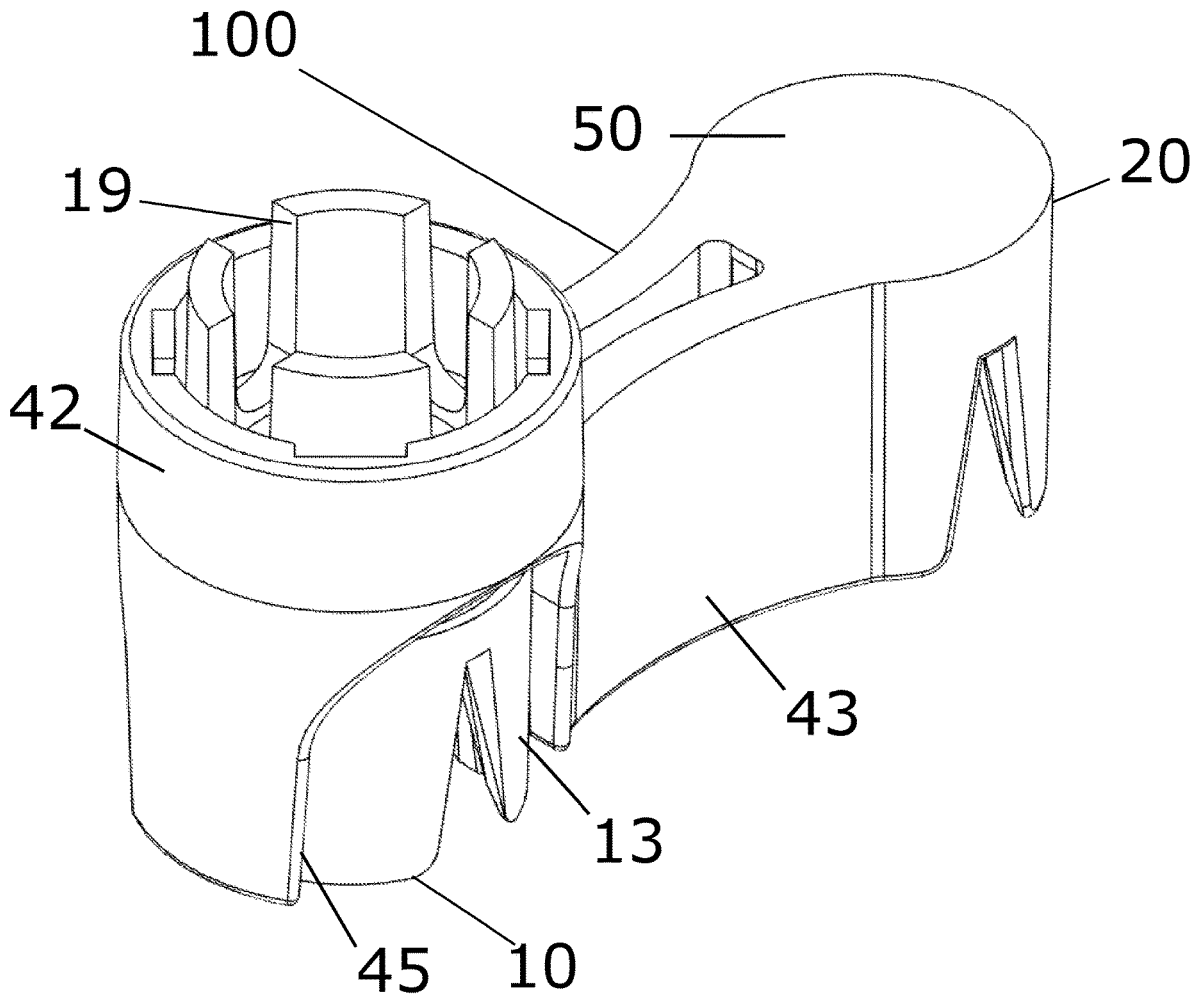
FIG. 9 is a bottom perspective view of one embodiment of the coupler-mounted connector with the coupler adaptor mounted on an affixed coupler.

The hollow well 14 may be an open space surrounded continuously or discontinuously by the upper region 13. The hollow well 14 is open at a top portion to receive terminal hooks. The coupler 10 may be hollow such that the upper region 13 and the body 11 are formed as hollow rings without a floor. Alternatively, the coupler 10 may have a floor 50 formed within as shown in FIG. 8 and FIG. 9.

The opening 15 is preferably formed in the upper region 13 with a wider upper dimension that tapers to a narrower seat 17 at the bottom of opening 15. The seat 17 is positioned at a height above an internal floor 50, if present, of the hollow well 14 to allow industry standard terminal hooks to rest on the seat 17 within opening 15 and hollow well 14 such that, when used as a rod and drape booth framework, the drapery walls have a uniform, flat appearance and the hooks are securely retained in the opening 15. Upper region 13 has a thickness at seat 17 that is sufficient to engage and retain the terminal hooks of the horizontal rods.

The top surfaces 18 of the coupler 10 are preferably rounded but may be beveled or flat. Similarly, the tapering surfaces of opening 15 may be beveled, rounded, or flat. Beveled, rounded, or other surfaces on the top surfaces 18 and the opening 15 may be used to facilitate the sliding of the terminal hooks into the opening 15.

The coupler 10 illustrated in FIG. 1 has an affixed base region 12 on the lower region of the coupler 10. The base region 12 allows the coupler 10 to be inserted into an opening in the top of a vertical pipe or tube. The base region 12 may have downwardly opening slots 19 which align with the traditional slots formed in standard vertical members to allow the slots on industry standard poles to remain usable when the coupler 10 is inserted into a standard support pipe. The slots 19 may have square, rounded or beveled edges and may include a web of material closing the lower end of the slot. The base region 12 may have a lattice or matrix structure to reduce raw material usage, reduce weight, and improve strength.

Preferably, coupler 10 will be made from durable reinforced polymer material, acrylonitrile butadiene styrene plastic, Delrin, polyurethane, or some other suitable material that has sufficient strength and rigidity to effectuate the connection. Coupler 20 may be substantially similar to coupler 10. The couplers 10, 20 may have similar features and perform similar functions.

Figure 2:
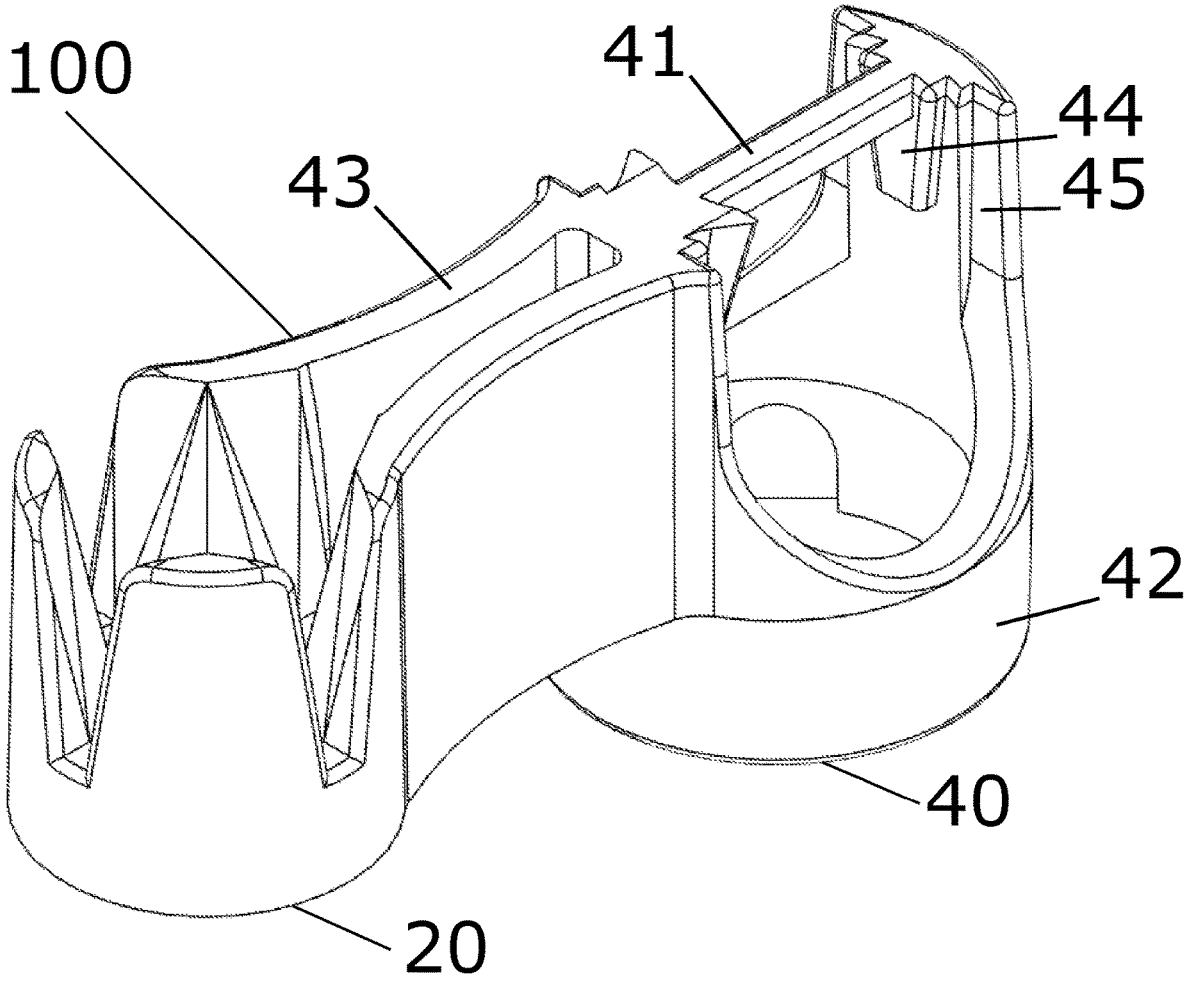
FIG. 2 is a perspective view of one embodiment of the coupler-mounted connector with the coupler adaptor.

FIG. 2 is a perspective view of one embodiment of a coupler-mounted connector 100 with coupler adaptor 40. The coupler-mounted connector 100 is shown with a single accessory attached, a coupler 20. The coupler adaptor 40 is configured to fit over a coupler 10 (not shown). In examples, an upper body 45 and a lower body 42 of the coupler adaptor 40 may be configured to slide around a coupler 10, such as a coupler 10 that is mounted on a vertical pipe or a wall mounted coupler 10. In an example, the lower body 42 forms a full circular body that encircles the body 11 of the coupler 10. The upper body 45 of the coupler adaptor 40 may be one or more sections that extend upwards from the lower body 42. The upper body 45 is configured to slide along the outside perimeter of the upper region 13 of the coupler 10. The upper body 45 is constructed with a sufficient width and depth to support the spanning element 41.

The spanning element 41 is connected to opposing sides of the upper body 45. The spanning element 41 has a lower wedge 44 that is disposed along the interior wall of the upper body 45 and on the bottom side of the spanning element 41. The spanning element 41 slides into the opening 15 (not shown) of the connector 10 when the coupler adaptor 40 is placed over the coupler 10. Because the opening 15 of a coupler 10 is tapered from a wider opening at the top to a smaller opening on the bottom, the lower wedge 44 of the spanning element 41 will lower into the opening 15 until the lower wedge 44 is as wide as the opening 15. In an example, the angle of the V shaped opening of the opening 15 is the same angle as the V shape of the lower wedge 44 such that, then mated, the opening 15 and the lower wedge 44 have contact along their mating surfaces. When the lower wedge 44 is as wide as the opening 15, the lower wedge 44 will rest on the coupler 10 and be supported in place by the coupler 10. Because the spanning element 41 spans across two openings 15 in the coupler 10, the coupler adaptor 40 is secured in place and will not spin or slide on the coupler 10. This secured position allows rods and other accessories to be attached to the coupler adaptor 40 securely and rigidly.

The accessory illustrated in FIG. 2 for the coupler adaptor 40 is a coupler 20. That is, the coupler adaptor 40 mates onto a coupler 10 on a vertical pipe or a wall mount and allows one or more accessories to be available for use. This example illustrates a coupler 20 that is offset from the coupler adaptor 40 to allow rods and other accessories to be connected to the coupler 20. Having the coupler 20 as an accessory allows the rods to be mounted in an offset position from the coupler 10. The coupler 20 in the example is substantially similar to the affixed coupler 10.

The coupler 20 allows a greater number of rods to be mounted to a single vertical pole than the coupler 10 alone. For example, coupler 10 may accept one or more rods in the uncovered openings 15 after the coupler adaptor 40 is affixed. When rods are affixed to coupler 10 and coupler 20, the rods may hang in a parallel configuration. Other types of accessories may be affixed to the coupler adaptor instead of, or in addition to, the coupler 20.

The coupler 20 is connected to the coupler adaptor 40 via a connection bridge 43. The connection bridge 43 may connect to the coupler adaptor 40 at the upper body 45, at the lower body 42, or in any combination of the two. The opposite end of the connection bridge 43 may connect to the coupler 20 in any suitable manner. For example, the connection bridge 43 is depicted as being affixed to the coupler adaptor 40 and/or the coupler 20. The connection bridge 43 may be affixed or adhered to the coupler adaptor 40 and/or the coupler 20 by screws, an adhesive, or any other connection method. Alternatively, the connection bridge 43, the coupler adaptor 40, and/or the coupler 20 may be molded, cast, or otherwise formed as a solitary piece or unit. The connection bridge 43 may be of any suitable length or configuration. In FIG. 2, the connection bridge 43 is shown as slightly curved but substantially level with the height of the coupler 10. In other examples, the connection bridge 43 is configured to raise or lower the coupler 20 to a level above or below the coupler 10. The distance away from the coupler 10 that the connection bridge 43 places the coupler 20 is also variable based on the length of the connection bridge 43.

Figure 3:
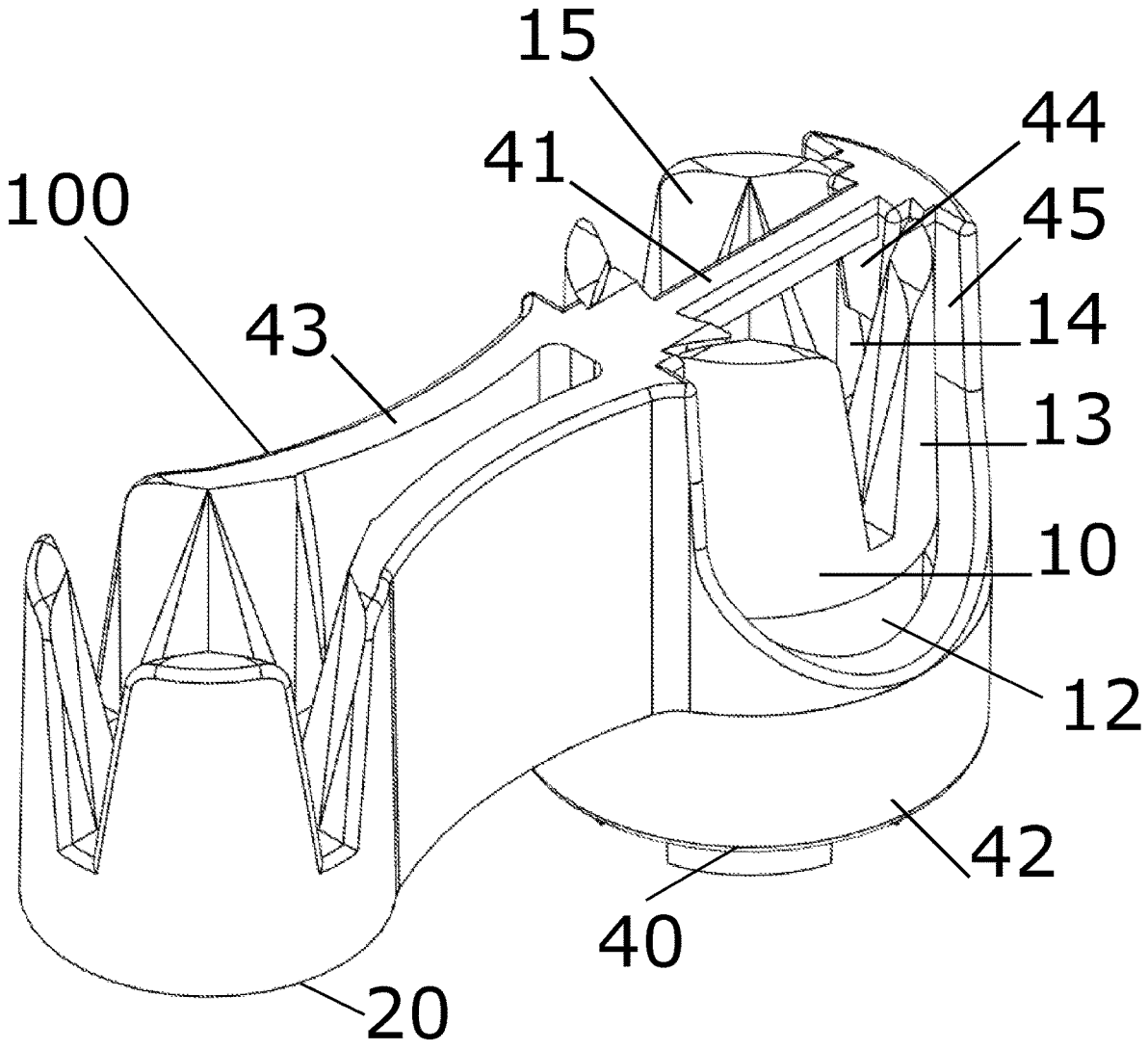
FIG. 3 is a perspective view of one embodiment of the coupler-mounted connector with the coupler adaptor on an affixed coupler.

FIG. 3 is a perspective view of one embodiment of the coupler-mounted connector 100 with the coupler adaptor 40 on an affixed coupler 10. The body 42 of the coupler adaptor 40 is positioned over and around the body of a coupler 10 and is supported by the coupler 10. The upper body 45 of the coupler adaptor 40 is positioned on the outside perimeter of the upper region 13 of the coupler 10. In this example, the body 42 is shown fitted over a vertical pipe-mounted coupler 10 as illustrated in FIG. 1. The lower wedge 44 of the spanning element 41 is shown fitted inside the opening 15 of the coupler 10. The lower wedge 44 is supported by the upper region 13 of the coupler 10 to hold the coupler adaptor 40 in place vertically and horizontally. The coupler adaptor 40 is also prevented from spinning or twisting by the fit between the spanning element 41 and the coupler 10. The spanning element 41 bridges the hollow well 14 of the coupler 10 to allow a lower wedge on each side of the coupler adaptor 40 to be locked into an opening 15 of the coupler 10. In the example, the spanning element 41 is a straight member and allows lower wedges 44 to be positioned in openings 15 on opposing sides of the coupler 10.

An accessory coupler 20 is illustrated on the end of the connection bridge 43 of the coupler adaptor 40. This arrangement would allow a connection to one or more rods to the side of the vertical pipe and coupler 10 supporting the coupler adaptor 40.

Figure 4:
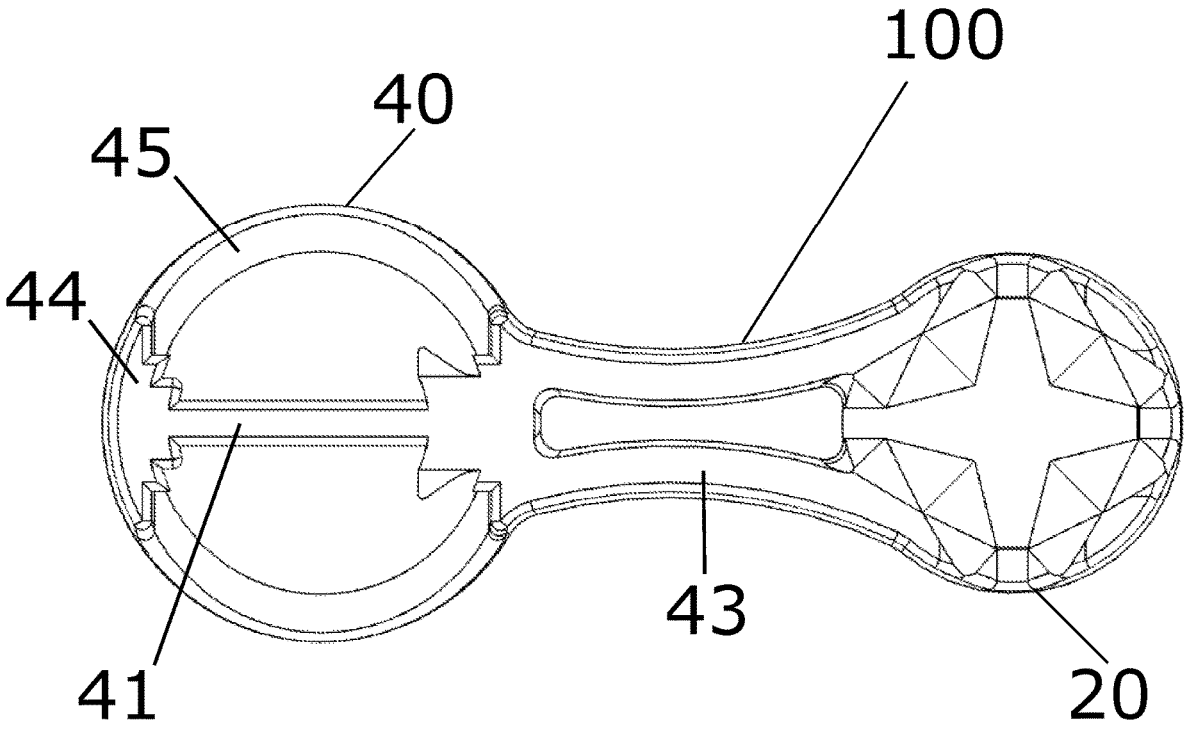
FIG. 4 is a top plan view of one embodiment of the coupler-mounted connector with the coupler adaptor.

FIG. 4 is a top plan view of one embodiment of the coupler-mounted connector 100 with the coupler adaptor 40. The coupler adaptor 40 is depicted with the upper body 45, the spanning element 41, and the lower wedge 44. The connection bridge 43 is depicted as connecting the coupler adaptor 40 with a coupler 20 as the accessory. The coupler adaptor 40 is configured to mount onto a coupler 10 as described herein.

Figure 5:
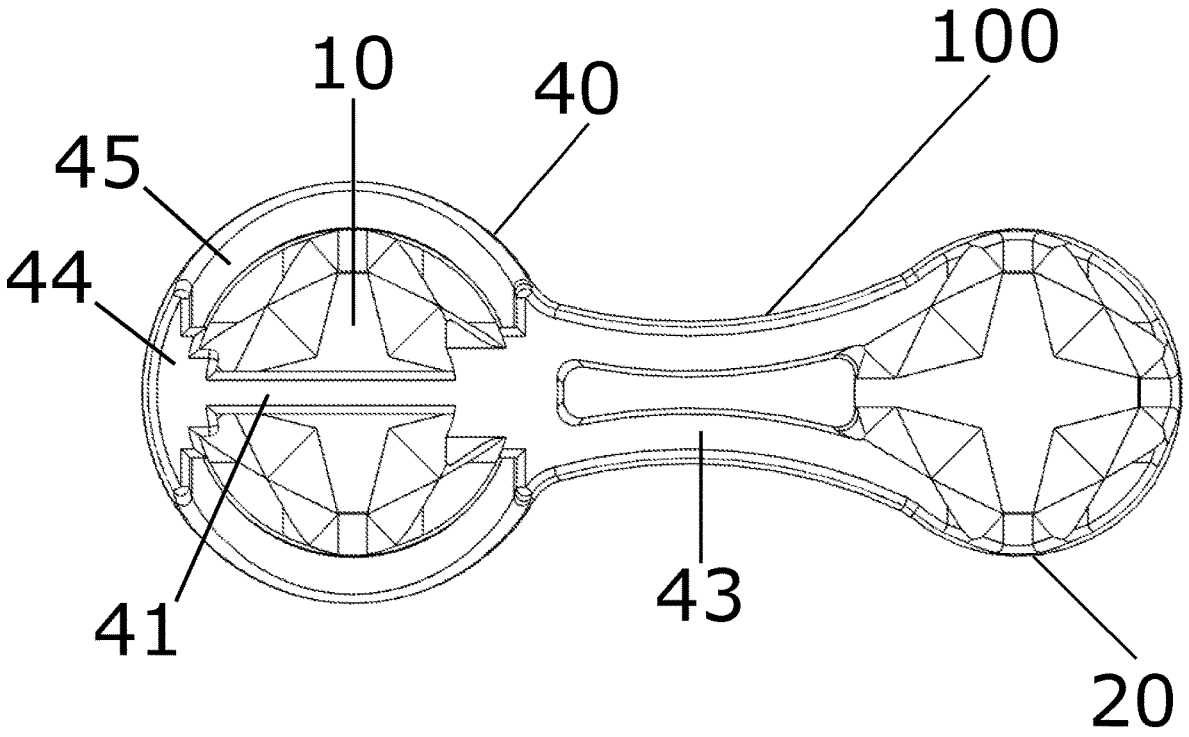
FIG. 5 is a top plan view of one embodiment of the coupler-mounted connector with the coupler adaptor mounted on an affixed coupler.

FIG. 5 is a top plan view of one embodiment of the coupler-mounted connector 100 with the coupler adaptor 40 mounted on an affixed coupler 10. The coupler adaptor 40 is depicted with the upper body 45, the spanning element 41, and the lower wedge 44. The connection bridge 43 is depicted as connecting the coupler adaptor 40 with a coupler 20 as the accessory. The coupler adaptor 40 is positioned over and around the body of a coupler 10 and is supported by the coupler 10. The upper body 45 of the coupler adaptor 40 is positioned on the outside perimeter of the upper region 13 of the coupler 10. In this example, the body 42 is shown fitted over a vertical pipe-mounted coupler 10 as illustrated in FIG. 1.

Figure 6:
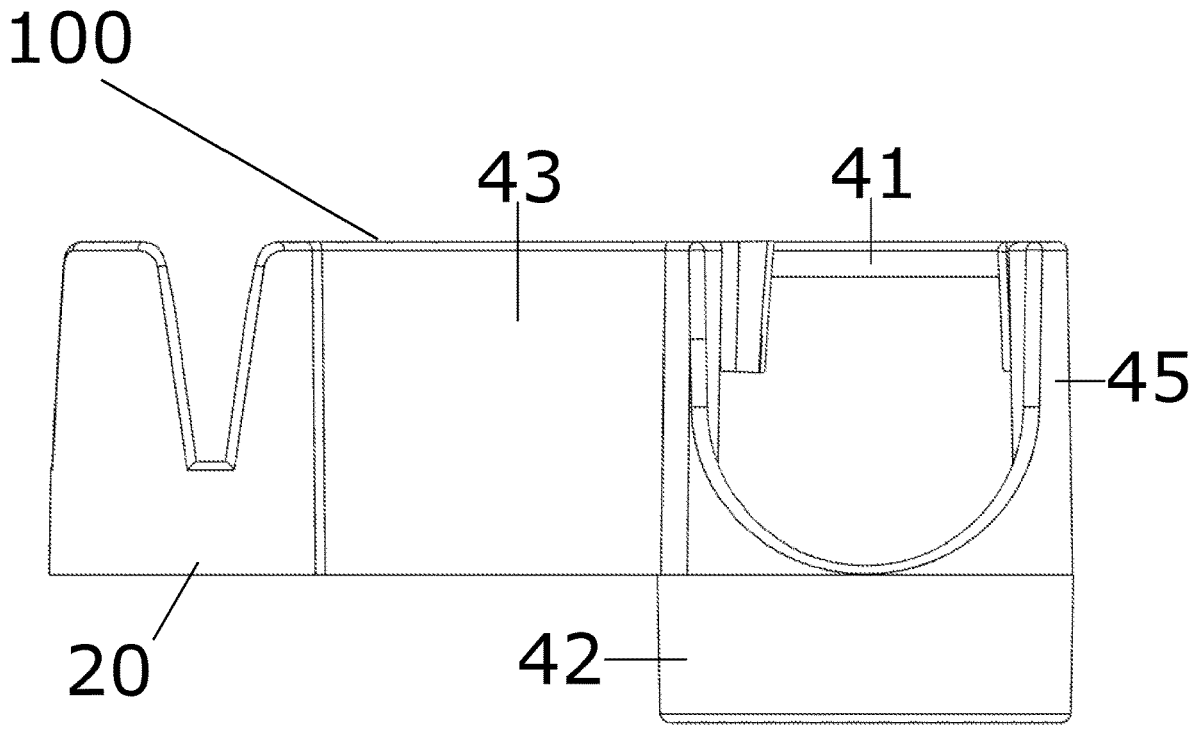
FIG. 6 is a side elevation view of one embodiment of the coupler-mounted connector with the coupler adaptor.

FIG. 6 is a side elevation view of one embodiment of the coupler-mounted connector 100 with the coupler adaptor 40. The coupler adaptor 40 is depicted with the upper body 45 and the spanning element 41. The connection bridge 43 is depicted as connecting the coupler adaptor 40 with a coupler 20 as the accessory. The coupler adaptor 40 is configured to mount onto a coupler 10 as described herein.

Figure 7:
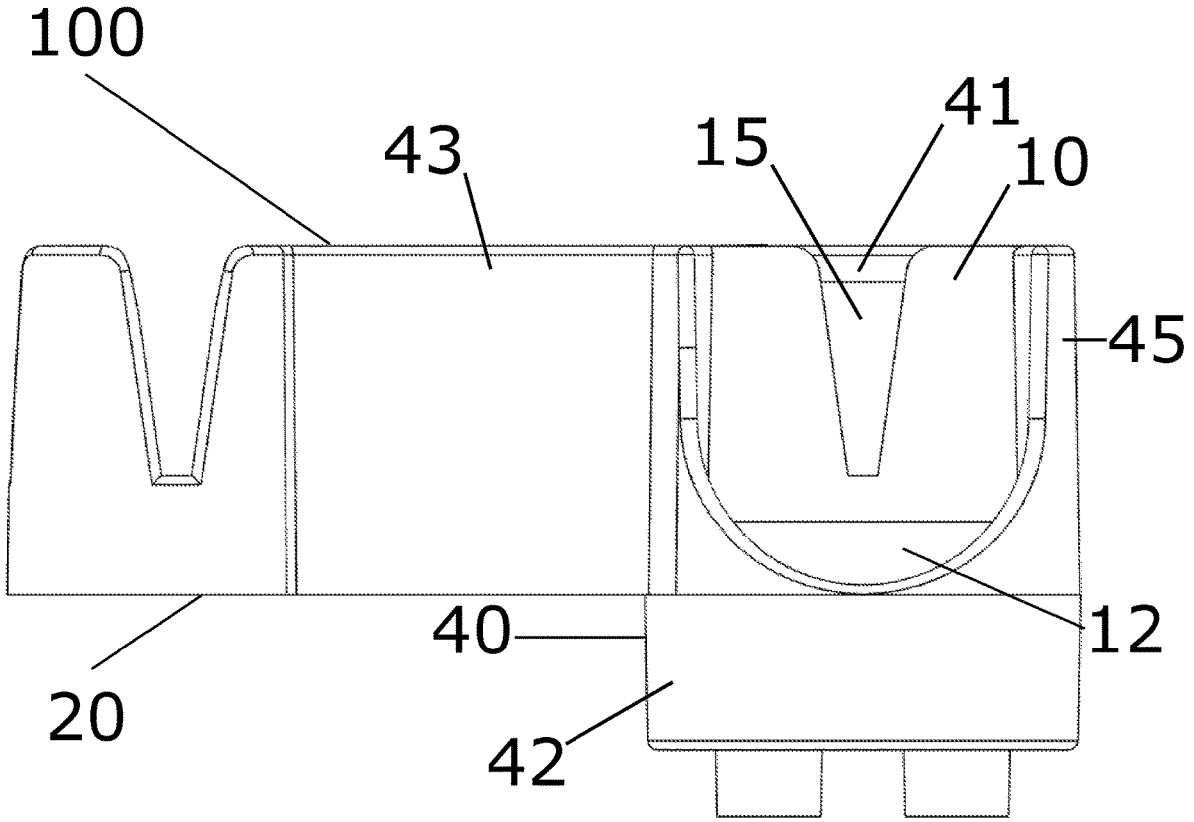
FIG. 7 is a side elevation view of one embodiment of the coupler-mounted connector with the coupler adaptor mounted on an affixed coupler.

FIG. 7 is a side elevation view of one embodiment of the coupler-mounted connector 100 with the coupler adaptor 40 mounted on an affixed coupler 10. The coupler adaptor 40 is depicted with the upper body 45 and the spanning element 41. The connection bridge 43 is depicted as connecting the coupler adaptor 40 with a coupler 20 as the accessory. The coupler adaptor 40 is positioned over and around the body of a coupler 10 and is supported by the coupler 10. The upper body 45 of the coupler adaptor 40 is positioned on the outside perimeter of the upper region 13 of the coupler 10. In this example, the body 42 is shown fitted over a vertical pipe-mounted coupler 10 as illustrated in FIG. 1.

The openings 15 on the coupler 10 are accessible to receive additional rods or other connectors. An example coupler 10 has four openings 15, each disposed 90 degrees apart, such as at 12:00, 3:00, 6:00, and 9:00 positions on a clock face. If the spanning element covers the 12:00 and 6:00 positions, the 3:00 and 9:00 positions are uncovered by the coupler adaptor 40 and may receive one or more rods and hooks.

FIG. 8 is a bottom perspective view of one embodiment of the coupler-mounted connector 100 with the coupler adaptor 40. The coupler adaptor 40 is depicted with the upper body 45, the spanning element 41, and the lower wedge 44. The connection bridge 43 is depicted as connecting the coupler adaptor 40 with a coupler 20 as the accessory. The seat 50 of the coupler is illustrated. The coupler adaptor 40 is configured to mount onto a coupler 10 as described herein.

FIG. 9 is a bottom perspective view of one embodiment of the coupler-mounted connector 100 with the coupler adaptor 40 mounted on an affixed coupler 10. The coupler adaptor 40 is depicted with the upper body 45. The spanning element 41 and the lower wedge 44 are hidden from view by the upper region 13 of the coupler 10. The connection bridge 43 is depicted as connecting the coupler adaptor 40 with a coupler 20 as the accessory. The seat 50 of the coupler is illustrated. The coupler adaptor 40 is positioned over and around the body of a coupler 10 and is supported by the coupler 10. The upper body 45 of the coupler adaptor 40 is positioned on the outside perimeter of the upper region 13 of the coupler 10. In this example, the body 42 is shown fitted over a vertical pipe-mounted coupler 10 as illustrated in FIG. 1.

Figure 10:
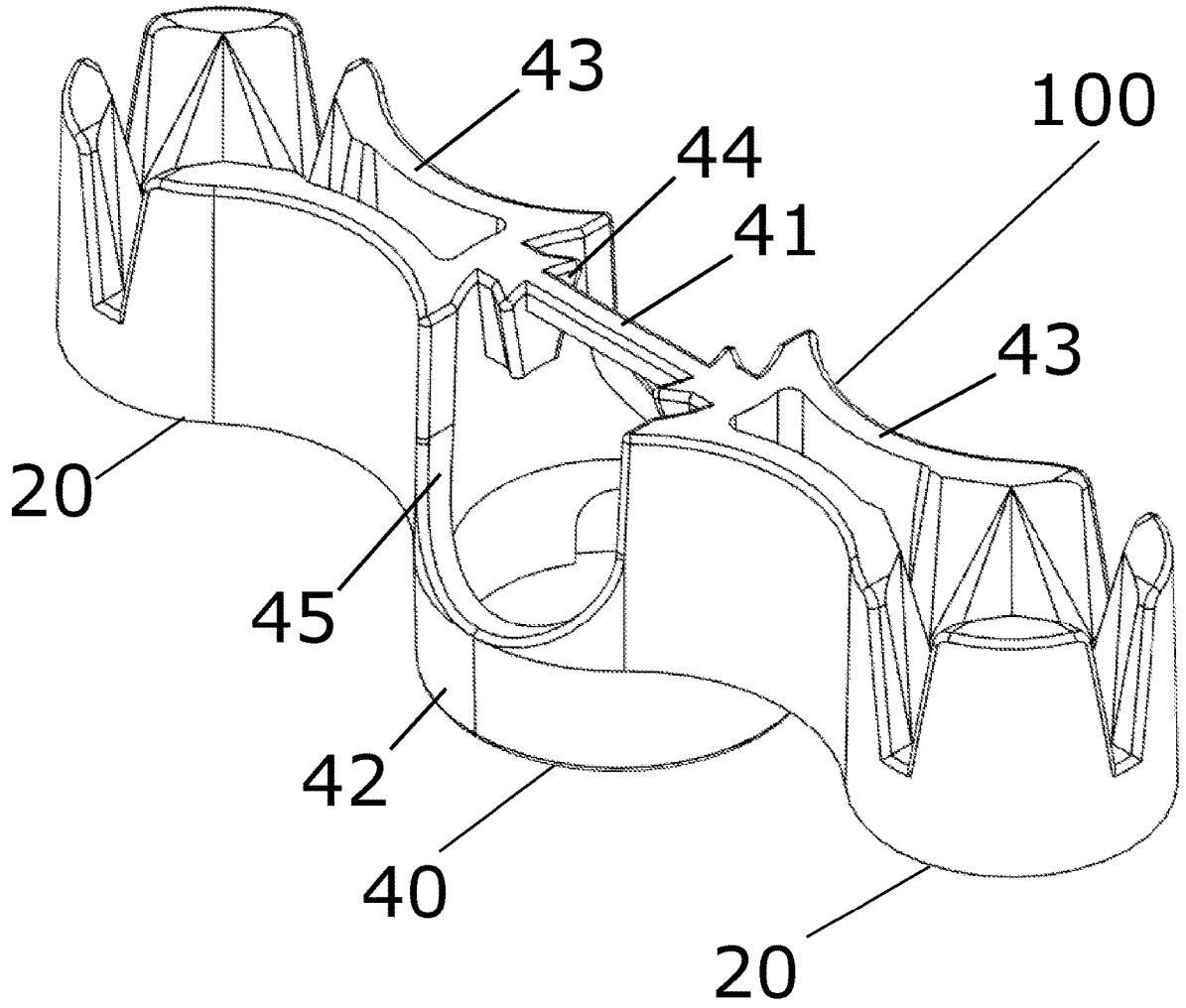
FIG. 10 is a perspective view of one embodiment of the coupler-mounted connector with the coupler adaptor with two couplers.

FIG. 10 is a perspective view of one embodiment of the coupler-mounted connector 100 with the coupler adaptor 40 with two couplers 20. The coupler adaptor 40 is depicted with the upper body 45, the spanning element 41, and the lower wedge 44. The coupler adaptor 40 is depicted with two connection bridges 43, one connection bridge 43 extending from opposing sides of the connector adaptor 40. Each of the connection bridges 43 is depicted as connecting the coupler adaptor 40 with a coupler 20 as the accessory. With two couplers 20 as accessories along with the of the coupler 10, a greater number of rods, drapes, hooks, or other devices may be used for display. The coupler adaptor 40 is configured to mount onto a coupler 10 as described herein.

Figure 11:
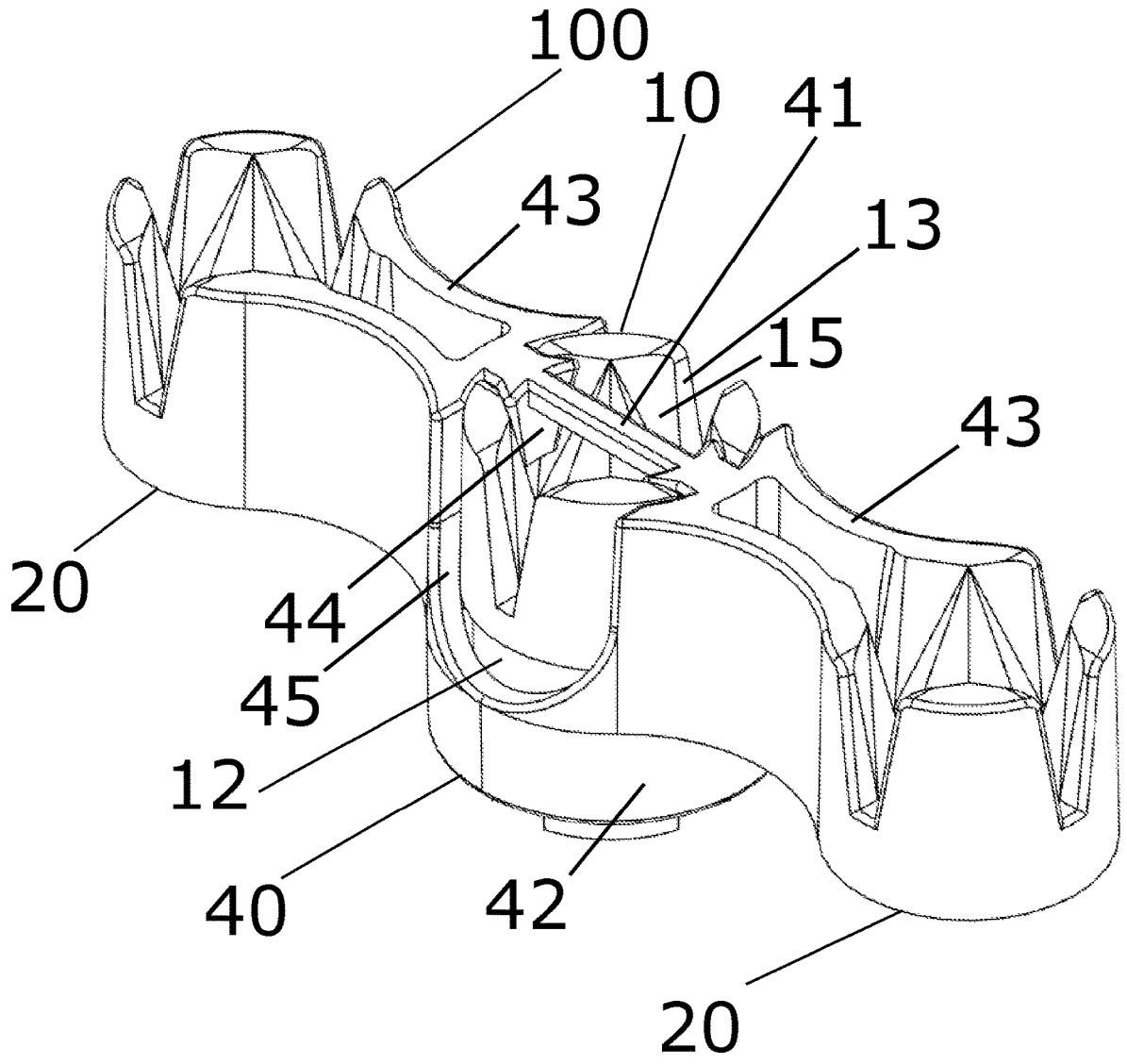
FIG. 11 is a perspective view of one embodiment of the coupler-mounted connector with the coupler adaptor with two couplers mounted on an affixed coupler.

FIG. 11 is a perspective view of one embodiment of the coupler-mounted connector 100 with the coupler adaptor 40 with two couplers mounted on an affixed coupler 10. The coupler adaptor 40 is depicted with the upper body 45, the spanning element 41, and the lower wedge 44. The coupler adaptor 40 is depicted with two connection bridges 43, one connection bridge 43 extending from opposing sides of the connector adaptor 40. Each of the connection bridges 43 is depicted as connecting the coupler adaptor 40 with a coupler 20 as the accessory. The coupler adaptor 40 is positioned over and around the body of a coupler 10 and is supported by the coupler 10. The upper body 45 of the coupler adaptor 40 is positioned on the outside perimeter of the upper region 13 of the coupler 10. The lower wedge 44 is supported by the upper region 13 of the coupler 10 to hold the coupler adaptor 40 in place vertically and horizontally. The coupler adaptor 40 is also prevented from spinning or twisting by the fit between the spanning element 41 and the coupler 10. The spanning element bridges the hollow well 14 of the coupler 10 to allow a lower wedge on each side of the coupler adaptor 40 to be locked into an opening 15 of the coupler 10. In the example, the spanning element 41 is a straight member and allows lower wedges 44 to be positioned in openings 15 on opposing sides of the coupler 10. In this example, the body 42 is shown fitted over a vertical pipe-mounted coupler 10 as illustrated in FIG. 1.

Figure 12:
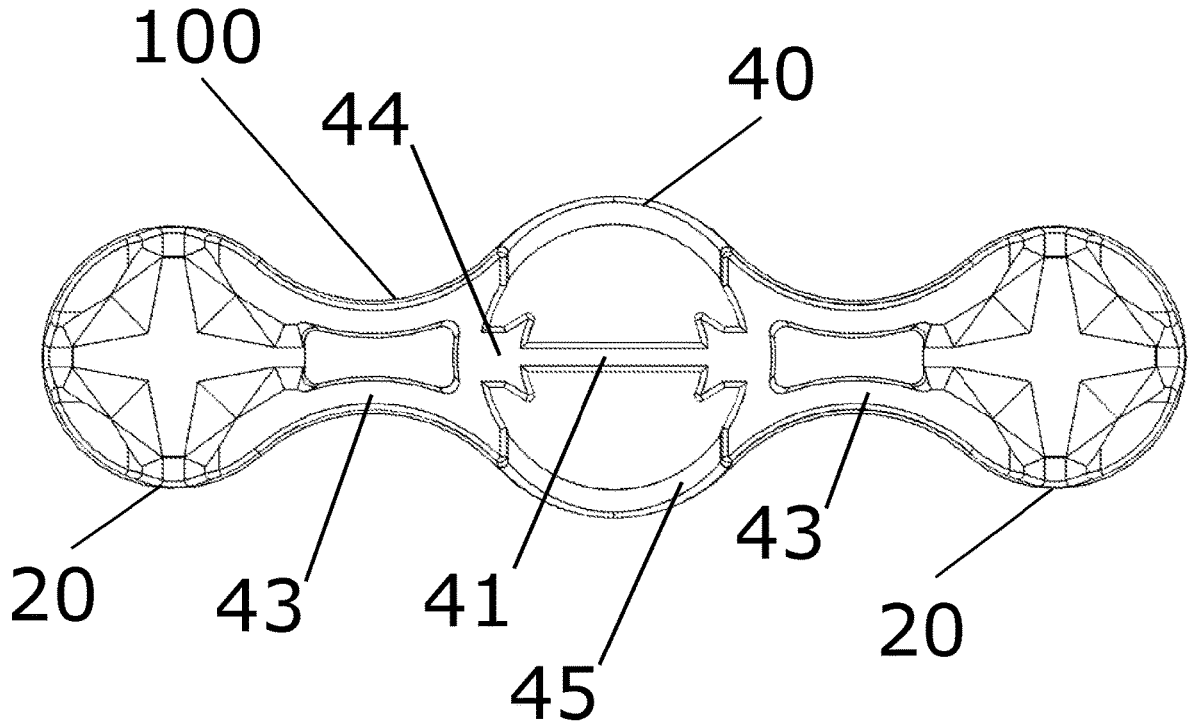
FIG. 12 is a top plan view of one embodiment of the coupler-mounted connector with the coupler adaptor with two couplers.

FIG. 12 is a top plan view of one embodiment of the coupler-mounted connector 100 with the coupler adaptor 40 with two couplers 20. The coupler adaptor 40 is depicted with the upper body 45, the spanning element 41, and the lower wedge 44. The coupler adaptor 40 is depicted with two connection bridges 43, one connection bridge 43 extending from opposing sides of the connector adaptor 40. The coupler adaptor 40 is configured to mount onto a coupler 10 as described herein.

Figure 13:
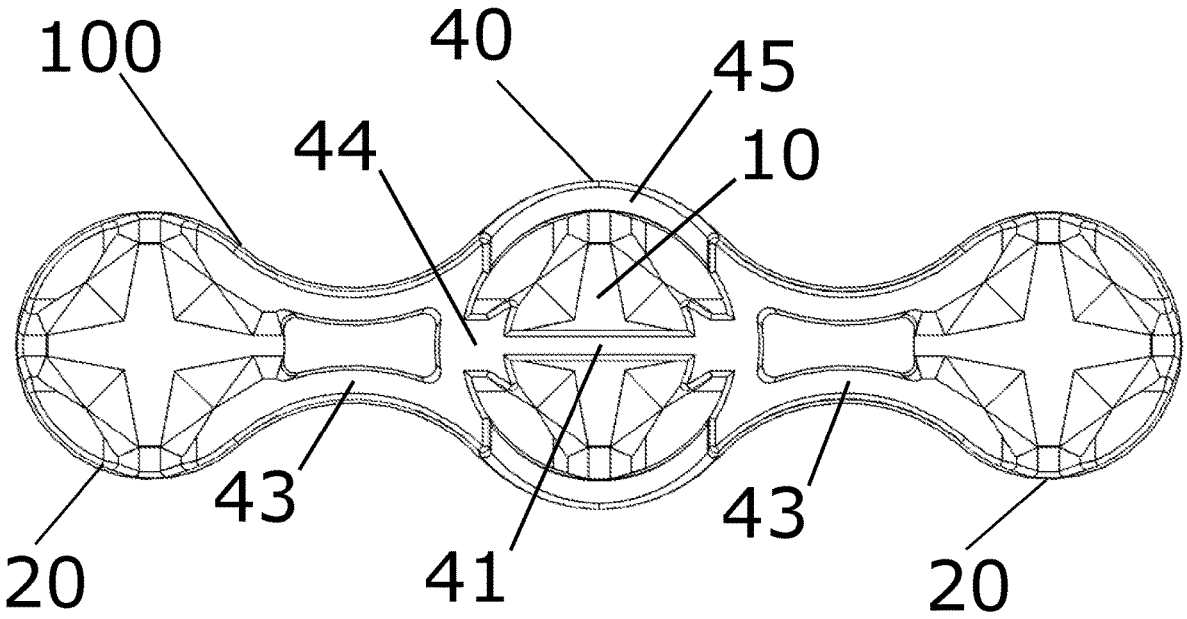
FIG. 13 is a top plan view of one embodiment of the coupler-mounted connector with the coupler adaptor with two couplers mounted on an affixed coupler.

FIG. 13 is a top plan view of one embodiment of the coupler-mounted connector 100 with the coupler adaptor 40 with two couplers 20 mounted on an affixed coupler 10. The coupler adaptor 40 is depicted with the upper body 45, the spanning element 41, and the lower wedge 44. The coupler adaptor 40 is depicted with two connection bridges 43, one connection bridge 43 extending from opposing sides of the connector adaptor 40. The coupler adaptor 40 is positioned over and around the body of a coupler 10 and is supported by the coupler 10. The upper body 45 of the coupler adaptor 40 is positioned on the outside perimeter of the upper region 13 of the coupler 10. In this example, the body 42 is shown fitted over a vertical pipe-mounted coupler 10 as illustrated in FIG. 1.

Figure 14:
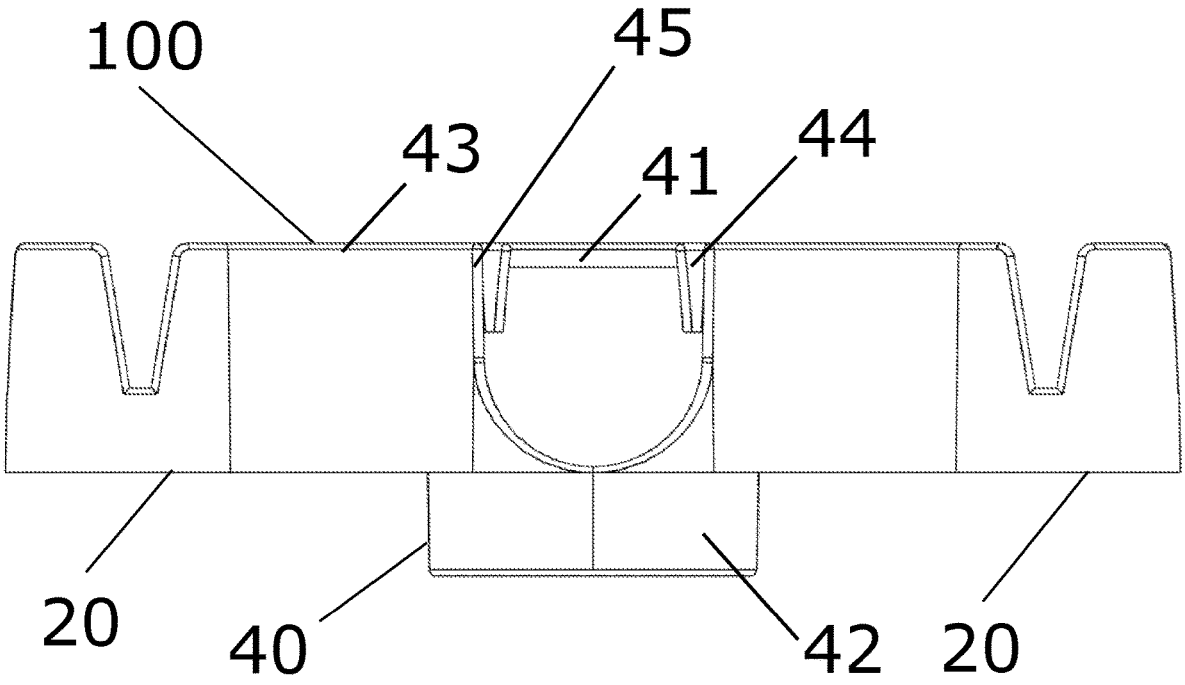
FIG. 14 is a side elevation view of one embodiment of the coupler-mounted connector with the coupler adaptor with two couplers.

FIG. 14 is a side elevation view of one embodiment of the coupler-mounted connector 100 with the coupler adaptor 40 with two couplers 20. The coupler adaptor 40 is depicted with the upper body 45 and the spanning element 41. The coupler adaptor 40 is depicted with two connection bridges 43, one connection bridge 43 extending from opposing sides of the connector adaptor 40. The coupler adaptor 40 is configured to mount onto a coupler 10 as described herein.

Figure 15:
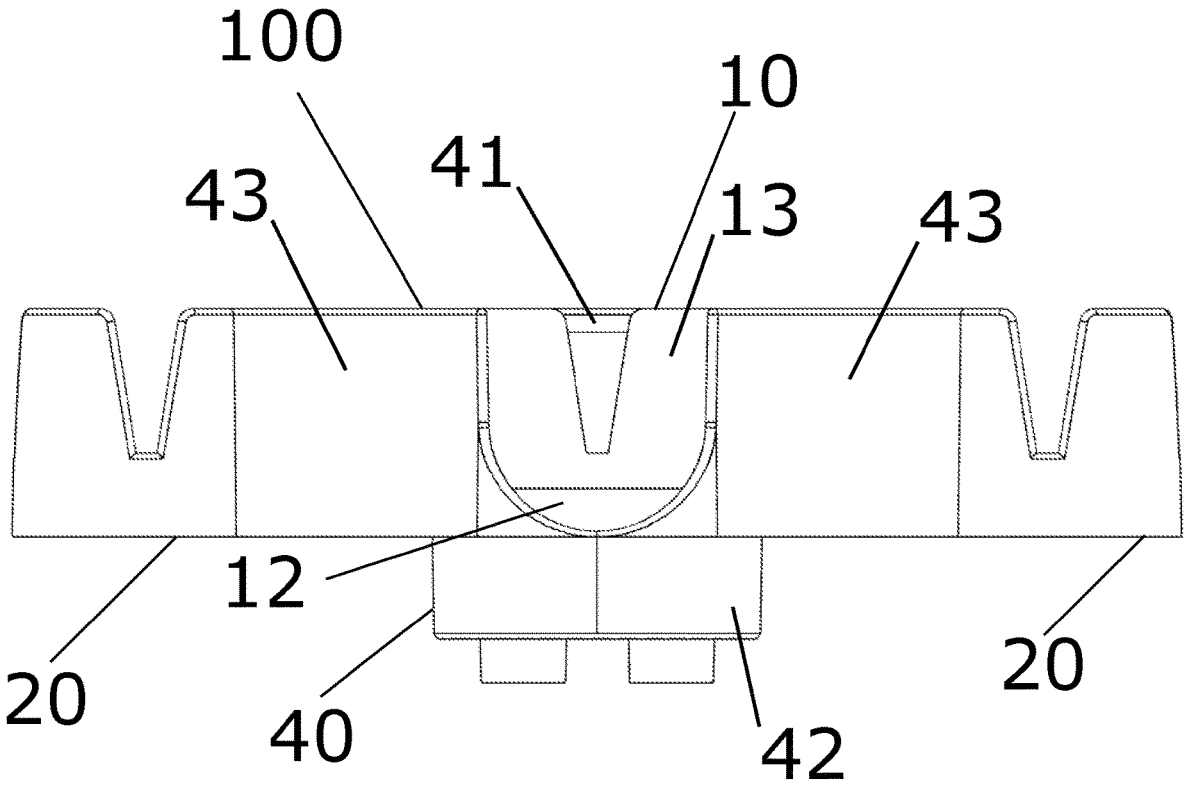
FIG. 15 is a side elevation view of one embodiment of the coupler-mounted connector with the coupler adaptor with two couplers mounted on an affixed coupler.

FIG. 15 is a side elevation view of one embodiment of the coupler-mounted connector 100 with the coupler adaptor with two couplers mounted on an affixed coupler 10. The coupler adaptor 40 is depicted with the upper body 45 and the spanning element 41. The coupler adaptor 40 is depicted with two connection bridges 43, one connection bridge 43 extending from opposing sides of the connector adaptor 40. The coupler adaptor 40 is positioned over and around the body of a coupler 10 and is supported by the coupler 10. The upper body 45 of the coupler adaptor 40 is positioned on the outside perimeter of the upper region 13 of the coupler 10. In this example, the body 42 is shown fitted over a vertical pipe-mounted coupler 10 as illustrated in FIG. 1.

The openings 15 on the coupler 10 are accessible to receive additional rods or other connectors. An example coupler 10 has four openings 15, each disposed 90 degrees apart, such as at 12:00, 3:00, 6:00, and 9:00 positions on a clock face. If the spanning element covers the 12:00 and 6:00 positions, the 3:00 and 9:00 positions are uncovered by the coupler adaptor 40 and may receive one or more rods and hooks.

Figure 16:
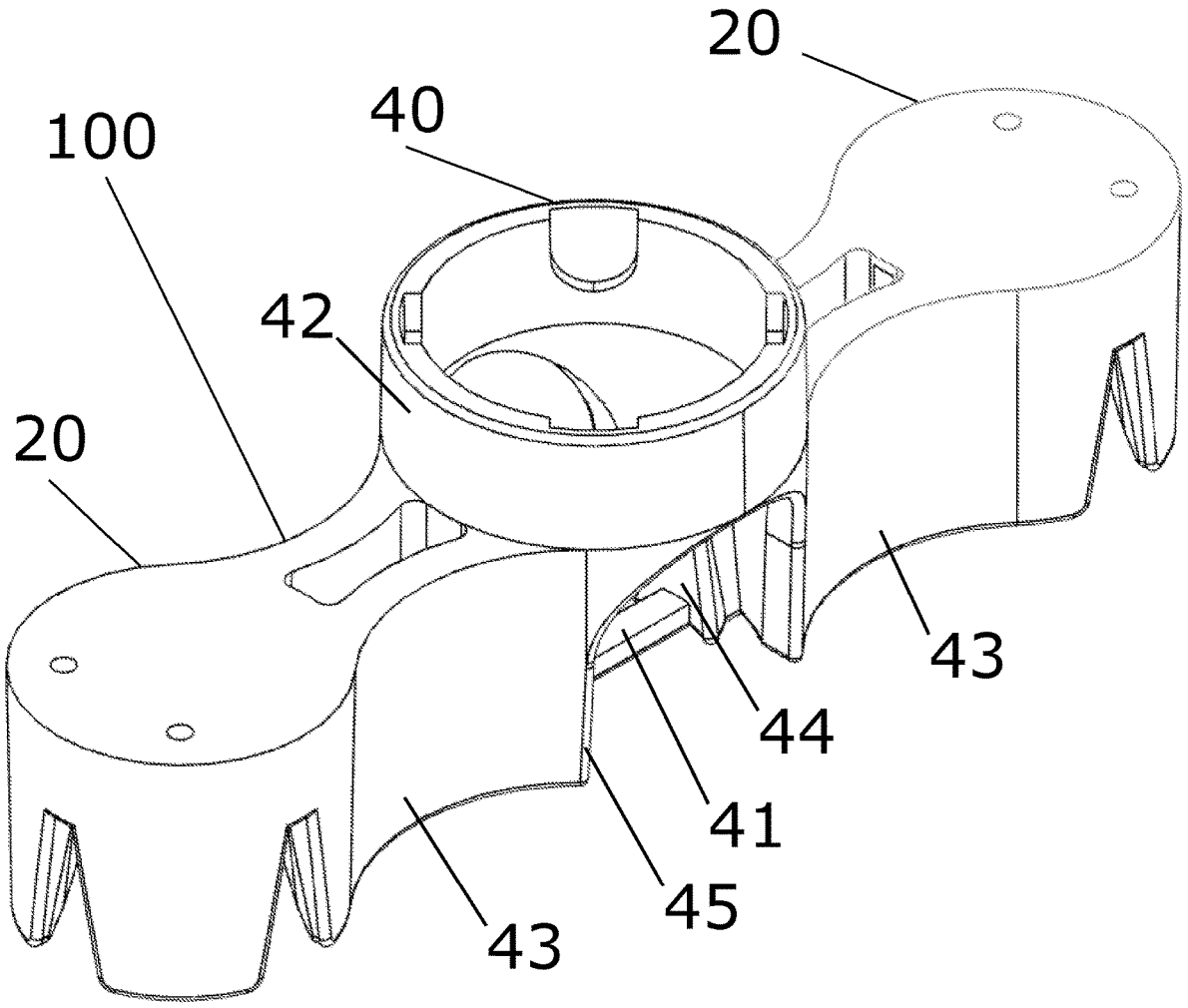
FIG. 16 is a bottom perspective view of one embodiment of the coupler-mounted connector with the coupler adaptor with two couplers.

FIG. 16 is a bottom perspective view of one embodiment of the coupler-mounted connector 100 with the coupler adaptor 40 with two couplers 20. The coupler adaptor 40 is depicted with the upper body 45, the spanning element 41, and the lower wedge 44. The coupler adaptor 40 is depicted with two connection bridges 43, one connection bridge 43 extending from opposing sides of the connector adaptor 40. The coupler adaptor 40 is configured to mount onto a coupler 10 as described herein.

Figure 17:
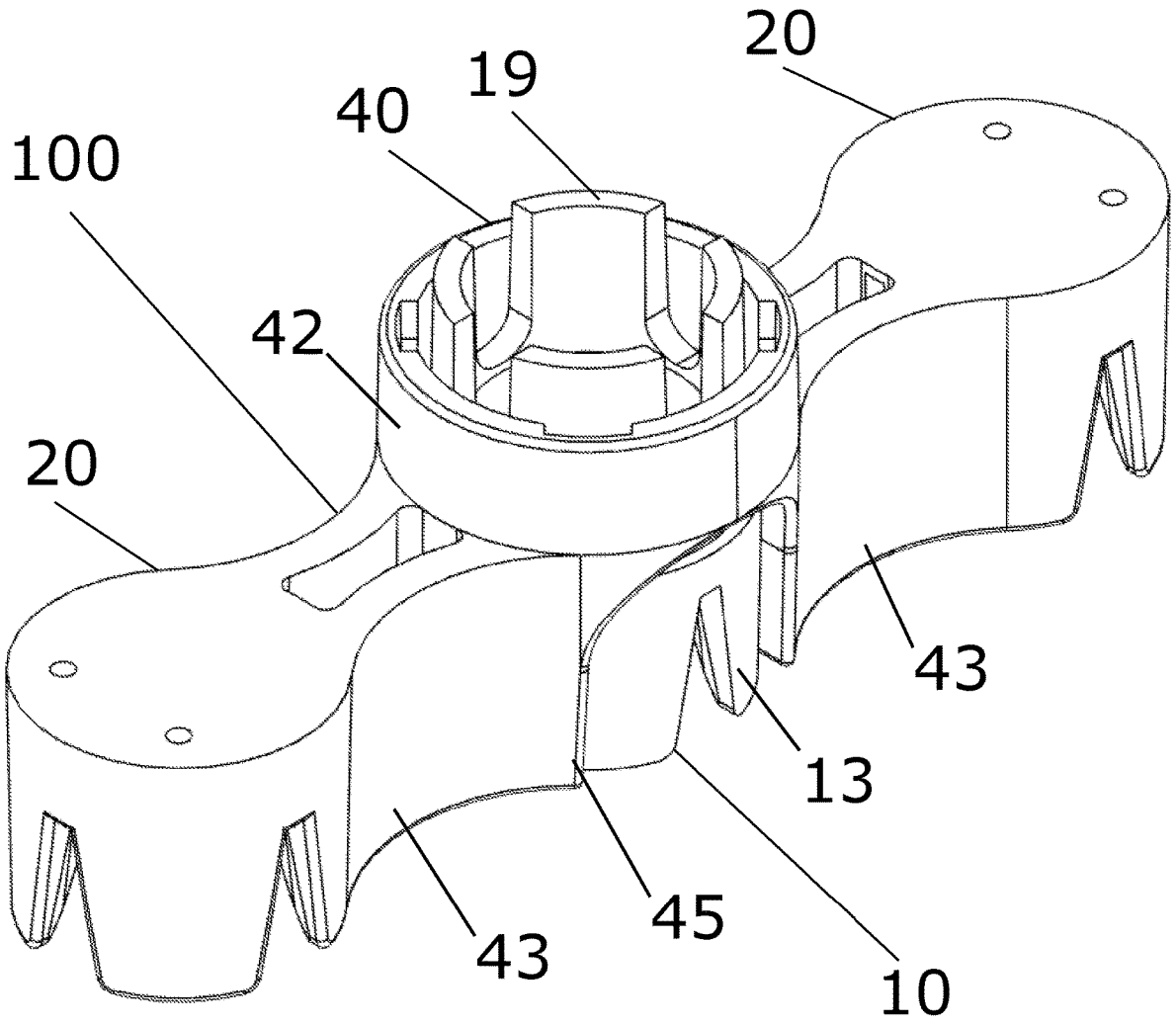
FIG. 17 is a bottom perspective view of one embodiment of the coupler-mounted connector with the coupler adaptor with two couplers mounted on an affixed coupler.

FIG. 17 is a bottom perspective view of one embodiment of the coupler-mounted connector 100 with the coupler adaptor 40 with two couplers 20 mounted on an affixed coupler 10. The coupler adaptor 40 is depicted with the upper body 45, the spanning element 41, and the lower wedge 44. The coupler adaptor 40 is depicted with two connection bridges 43, one connection bridge 43 extending from opposing sides of the connector adaptor 40. Each of the connection bridges 43 is depicted as connecting the coupler adaptor 40 with a coupler 20 as the accessory. With two couplers 20 as accessories along with the coupler 10, a greater number of rods, drapes, hooks, or other devices may be used for display. The coupler adaptor 40 is configured to mount onto a coupler 10 as described herein.

Figure 18:
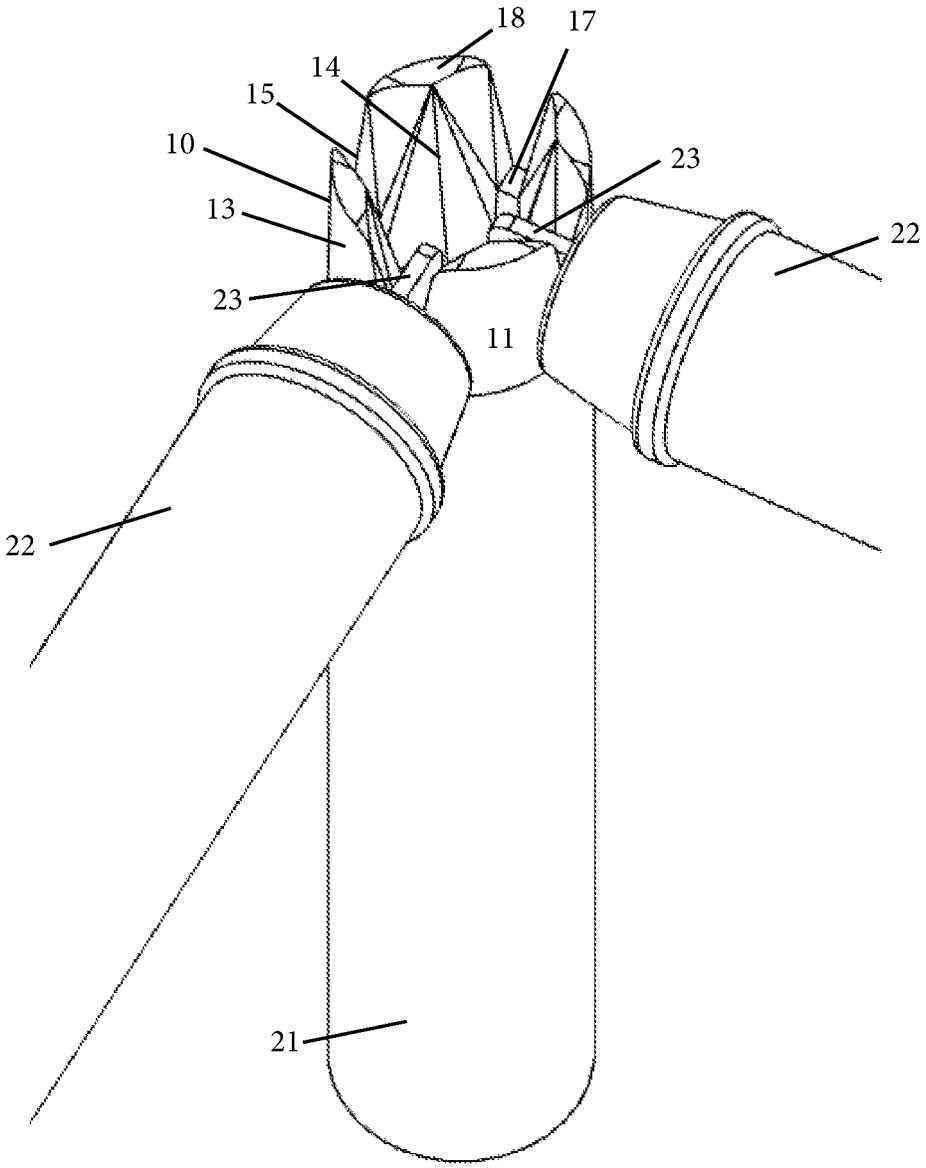
FIG. 18 is a perspective view of one embodiment of industry standard horizontal drape rods affixed to the affixed coupler.

FIG. 18 is a perspective view of one embodiment of industry standard horizontal drape rods 22 affixed to the affixed coupler 10, in accordance with certain examples. FIG. 18 depicts coupler 10 inserted into an opening in the top of a vertical pipe 21. Horizontal rods 22 with terminal hooks 23 (terminal connectors) are depicted resting on seats 17 within openings 15. While two horizontal rods 22 are depicted, any suitable number of horizontal rods 22 may be affixed to coupler 10 by terminal hooks 23 resting on seats 17 within openings 15.

In alternate embodiments of the technology, any other suitable accessory may be supported by the coupler adaptor 40. For example, simple hooks, traditional rod connectors, plates with grooves to receive a drape rod terminal end, or any other suitable accessory for hanging drapes and other rod and pipe elements.

In an alternate example of the technology, a bottom portion of the body 42 of the coupler adaptor 40 does not encircle the coupler adaptor 40. By leaving a section of the body 42 open, the coupler adaptor 40 is adapted to fit over a coupler 10 that is wall mounted or has any other accessory, extension, mounting hardware, or any other portion that would prevent a round body 42 from encircling the coupler 10. That is, the coupler adaptor 40 will fit over a coupler 10 that includes the connection bridge 43 for affixing to a wall mounted coupler 10.

While in the foregoing specification this invention has been described in relation to certain embodiments thereof, and many details have been put forth for the purpose of illustration, it will be apparent to those skilled in the art that the invention is susceptible to additional embodiments and that certain of the details described herein can be varied considerably without departing from the basic principles of the invention.

What is claimed is:

1. A connector for tubular members, comprising:

a coupler adaptor supporting accessories to a coupler, the coupler encompassing an upwardly opening well formed within a body of an upper region, the upwardly opening well of the upper region of the coupler defining a plurality of upwardly opening slots disposed therein with each slot sized to receive therein a terminal connector connected to a drape rod, and the coupler adaptor comprising a circular body to slide over an outside perimeter of the coupler and a spanning element spanning across an interior of an upper portion of the circular body of the coupler adaptor, the spanning element comprising a lower wedge, the spanning element connected to opposing sides of the interior of the upper portion of the circular body of the coupler adaptor and configured to rest in the upper region of the coupler with the lower wedge engaging with one or more upwardly opening slots of the plurality of upwardly opening slots as the circular body of the coupler adaptor is slid over the outside perimeter of the coupler.

2. The connector of claim 1, wherein the spanning element rests inside at least two of the upwardly opening slots of the upper region of the coupler.

3. The connector of claim 1, wherein the accessories comprise one or more accessories configured to receive terminal connectors connected to drape rods.

4. The connector of claim 1, wherein the accessories comprise one or more additional couplers substantially similar to the coupler.

5. The connector of claim 1, wherein the spanning element is of a sufficient width that when the coupler adaptor is affixed to the coupler, a top of the coupler adaptor is substantially horizontally level with a top of the coupler based on the plurality of upwardly opening slots of the coupler having an upper dimension greater than a dimension of the lower wedge of the spanning element with the slots diverging away from a seat of the coupler.

6. The connector of claim 5, wherein the lower wedge is configured with a V-shaped construction that, when inserted into a respective upwardly opening slot of the plurality of upwardly opening slots of the coupler allows the coupler adaptor to be lowered until the width of the lower wedge matches the width of the respective upwardly opening slot.

7. The connector of claim 1, wherein the accessories are connected to the coupler adaptor by one or more connection bridges.

8. The connector of claim 1, wherein two accessories are each connected to the coupler adaptor by one of two connection bridges, the two connection bridges being affixed on opposing sides of the coupler adaptor.

9. The connector of claim 1, further comprising at least one horizontally extending rod having a terminal connector with a hook end that is capable of being slotted into a particular upwardly opening slot of the upper region.

10. The connector of claim 1, wherein the body of the coupler adaptor comprises openings that when mounted on the coupler are suitable to allow access to one or more unused upwardly opening slots of the coupler.

11. The connector of claim 1, wherein the coupler adaptor is made of a polymer material.

12. The connector of claim 1, wherein the coupler adaptor, a connection bridge, and a coupler accessory are constructed as a single piece.

13. The connector of claim 1, wherein the coupler is mounted onto a top of a vertically mounted tube or pipe.

14. A method to couple rods, comprising:

affixing a coupler adaptor to support accessories to a coupler, the coupler encompassing an upwardly opening well formed within a body of an upper region, the upwardly opening well of the upper region of the coupler defining a plurality of upwardly opening slots disposed therein with each slot sized to receive therein a terminal connector connected to a drape rod, and the coupler adaptor comprising a circular body to slide over an outside perimeter of the coupler and a spanning element spanning across an interior of an upper portion of the circular body of the coupler adaptor, the spanning element comprising a lower wedge, the spanning element connected to opposing sides of an interior of the upper portion the circular body of the coupler adaptor and configured to rest in the upper region of the coupler with the lower wedge engaging with one or more upwardly opening slots of the plurality of upwardly opening slots as the body is slid over the outside perimeter of the coupler.

* * * * *